US009372454B2

(12) United States Patent
Matsuyama et al.

(10) Patent No.: US 9,372,454 B2
(45) Date of Patent: Jun. 21, 2016

(54) FIXING DEVICE COMPRISING HEAT INSULATING MEMBER INTERPOSED BETWEEN ROTATING MEMBER AND BEARING AND ROTATED AROUND ROTATION AXIS AND IMAGE FORMING APPARATUS INCLUDING THE SAME

(71) Applicant: KYOCERA Document Solutions Inc., Osaka (JP)

(72) Inventors: Ryo Matsuyama, Osaka (JP); Tomohiko Yamakawa, Osaka (JP); Masaru Takagi, Osaka (JP); Masami Fuchi, Osaka (JP); Masahiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/808,515

(22) Filed: Jul. 24, 2015

(65) Prior Publication Data

US 2016/0041512 A1 Feb. 11, 2016

(30) Foreign Application Priority Data

Aug. 11, 2014 (JP) ..... 2014-163279
Jun. 19, 2015 (JP) ..... 2015-124093

(51) Int. Cl.
*G03G 15/20* (2006.01)

(52) U.S. Cl.
CPC .... *G03G 15/2053* (2013.01); *G03G 2215/2032* (2013.01)

(58) Field of Classification Search
CPC ..... G03G 15/2053; G03G 2215/2032
USPC ..... 399/328
See application file for complete search history.

(56) References Cited

U.S. PATENT DOCUMENTS 4,952,782 A * 8/1990 Yokokawa ..... G03G 15/2053 219/469
8,746,980 B2 * 6/2014 Oki ..... G03G 15/2053 384/213
2006/0153606 A1 * 7/2006 Eichhorn ..... G03G 15/2053 399/330
2007/0048047 A1 * 3/2007 Matsuno ..... G03G 15/2053 399/333
2007/0092311 A1 * 4/2007 Fujimoto ..... G03G 15/2053 399/328
2007/0122212 A1 * 5/2007 Shinkawa ..... G03G 15/2025
2008/0193175 A1 * 8/2008 Fujimoto ..... G03G 15/2053 399/320
2013/0315638 A1 * 11/2013 Sawamura ..... G03G 15/2053
2013/0336607 A1 * 12/2013 Hirose ..... G03G 15/2053 384/397
2014/0226927 A1 * 8/2014 Ishii ..... G03G 21/1647 384/291

FOREIGN PATENT DOCUMENTS

JP 06-337608 A 12/1994

* cited by examiner

*Primary Examiner* — Susan Lee
(74) *Attorney, Agent, or Firm* — Studebaker & Brackett PC

(57) ABSTRACT

A fixing device includes a rotating member, a bearing and a heat insulating member. The rotating member fixes a toner image onto a recording medium. The bearing rotatably supports the rotating member. The heat insulating member is interposed between the rotating member and the bearing and rotated around a rotation axis. A notch part is arranged in a portion in a circumferential direction of the heat insulating member so as to continue from an end part at an inside to an end part at an outside in a direction of the rotation axis. At least one groove part is formed in a contact portion with the rotating member or the bearing in a circumference face of the heat insulating member.

17 Claims, 13 Drawing Sheets

FIXING DEVICE COMPRISING HEAT INSULATING MEMBER INTERPOSED BETWEEN ROTATING MEMBER AND BEARING AND ROTATED AROUND ROTATION AXIS AND IMAGE FORMING APPARATUS INCLUDING THE SAME

INCORPORATION BY REFERENCE

This application is based on and claims the benefit of priority from Japanese Patent application No. 2014-163279 filed on Aug. 11, 2014, and Japanese Patent application No. 2015-124093 filed on Jun. 19, 2015, the entire contents of which are incorporated herein by reference.

BACKGROUND

The present disclosure relates to a fixing device fixing a toner image on a recording medium and an image forming apparatus including this fixing device.

Conventionally, an electrographic image forming apparatus, such as a copying machine or a printer, includes a fixing device fixing a toner image on a recording medium, such as a sheet.

For example, there is a fixing device including a rotating member fixing the toner image on the recording medium, a bearing rotatably supporting the rotating member and a heat insulating member interposed between the rotating member and the bearing.

In the fixing device including such structure, when fixing the toner image on the recording medium, the rotating member is thermally expanded. According to this, it is feared that a large load is applied to the heat insulating member interposed between the rotating member and the bearing and the heat insulating member is broken. Thereupon, in the above-mentioned fixing device, the heat insulating member includes a notch part. Moreover, in the above-mentioned fixing device, the heat insulating member is composed of two components fitted to each other.

However, as mentioned above, if the heat insulating member includes the notch part, it is feared that torsion occurs around the notch part in the heat insulating member when operation fixing the toner image on the recording medium is carried out, and accordingly, abnormal noise occurs. Moreover, in the above-mentioned fixing device, because the heat insulating member is composed of two components, structure of the heat insulating member is complicated.

SUMMARY

In accordance with an embodiment of the present disclosure, a fixing device includes a rotating member, a bearing and a heat insulating member. The rotating member fixes a toner image onto a recording medium. The bearing rotatably supports the rotating member. The heat insulating member is interposed between the rotating member and the bearing and rotated around a rotation axis. A notch part is arranged in a portion in a circumferential direction of the heat insulating member so as to continue from an end part at an inside to an end part at an outside in a direction of the rotation axis. At least one groove part is formed in a contact portion with the rotating member or the bearing in a circumference face of the heat insulating member.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

A first embodiment of the present disclosure will be described.

Figure 1:
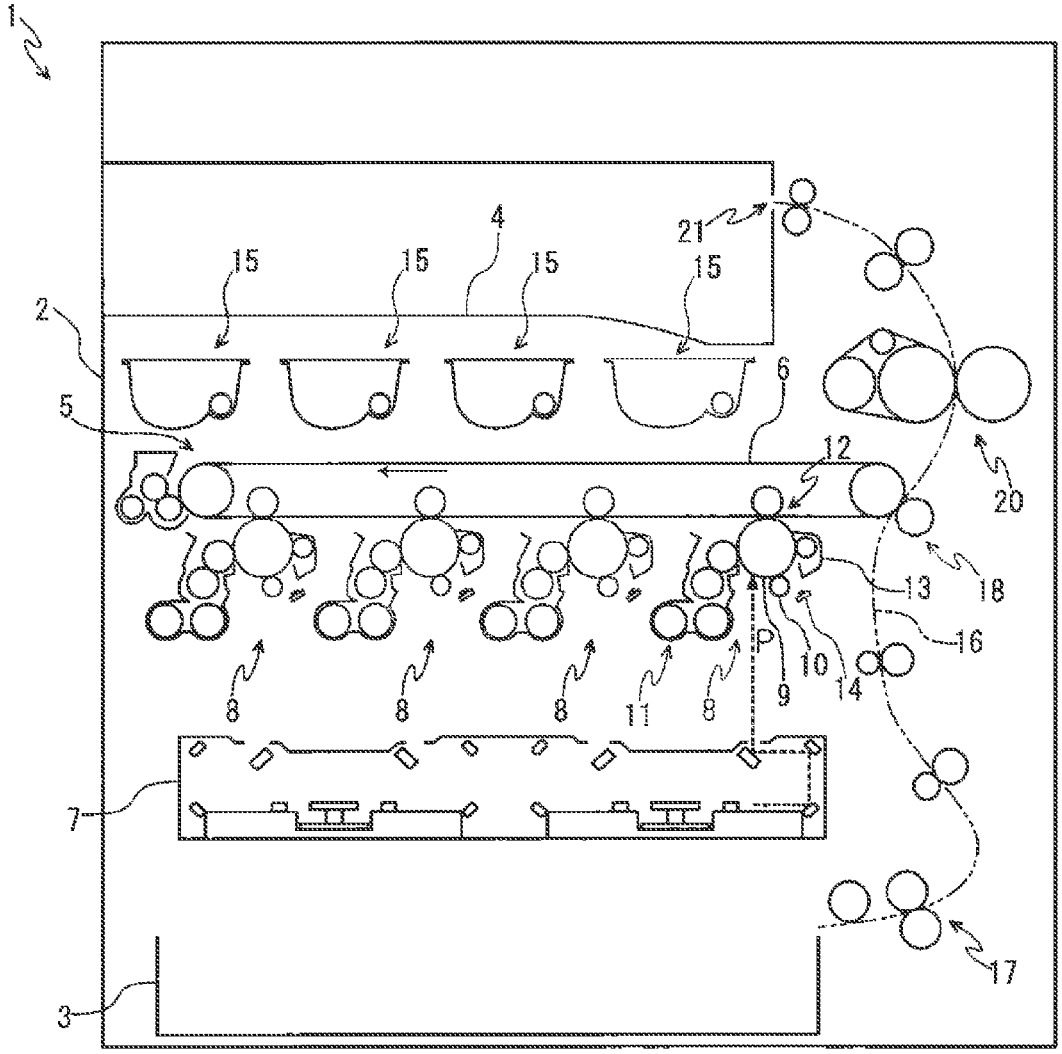
FIG. 1 is a schematic diagram schematically showing structure of a color printer according to a first embodiment of the present disclosure.

Firstly, with reference to FIG. 1, the entire structure of a color printer 1 (an image forming apparatus) will be described.

The color printer 1 includes a box-formed printer main body 2. In a lower part of the printer main body 2, a sheet feeding cartridge 3 storing a sheet (a recording medium) is arranged. In an upper part of the printer main body 2, an ejected sheet tray 4 is arranged.

In a middle part inside the printer main body 2, an intermediate transferring belt 6 is disposed around a plurality of rollers. Below the intermediate transferring belt 6, an exposure device 7 composed of a laser scanning unit (LSU) is arranged. At a lower side of the intermediate transferring belt 6, four image forming parts 8 are installed for respective colors (e.g. four colors of magenta, cyan, yellow and black) of a toner (a developer). In each image forming part 8, a photosensitive drum 9 is rotatably arranged. Around the photosensitive drum 9, a charger 10, a development device 11, a first transferring part 12, a cleaning device 13 and a static eliminator 14 are located in order of first transferring processes. Above the development device 11, each of toner containers 15 corresponding to the respective image forming parts 8 are arranged for the respective toner colors (e.g. four colors of magenta, cyan, yellow and black).

At one side (at a right side on the figure) inside the printer main body 2, a conveying path 16 for the sheet is arranged in upward and downward directions. At an upstream end of the conveying path 16, a sheet feeding part 17 is positioned. At an intermediate stream part of the conveying path 16, a second transferring part 18 is positioned at one end (a right end on the figure) of the intermediate transferring belt 6. At a downstream part of the conveying path 16, a fixing part 20 is positioned. At a downstream end of the conveying path 16, a sheet ejection port 21 is positioned.

Next, the operation of forming an image by the color printer 1 having such a configuration will be described. When the power is supplied to the color printer 1, various parameters are initialized and initial determination, such as temperature determination of the fixing part 20, is carried out. Subsequently, in the color printer 1, when image data is inputted and a printing start is directed from a computer or the like connected with the color printer 1, image forming operation is carried out as follows.

Firstly, the surface of the photosensitive drum 9 is electrically charged by the charger 10. Then, an electrostatic latent image is formed on the surface of the photosensitive drum 9 by a laser light (refer to an arrow P) from the exposure device 7. The electrostatic latent image is developed to a toner image having a correspondent color in the development device 11 by the toner supplied from each toner container 15. The toner image is first-transferred onto the surface of the intermediate transferring belt 6 in the first transferring part 12. The above-mentioned operation is repeated in order by the respective image forming parts 8, thereby forming the toner image having full color onto the intermediate transferring belt 6. Incidentally, toner and electric charge remained on the photosensitive drum 9 are removed by the cleaning device 13 and the static eliminator 14.

On the other hand, the sheet fed from the sheet feeding cartridge 3 or a manual bypass tray (not shown) by the sheet feeding part 17 is conveyed to the second transferring part 18 in a suitable timing for the above-mentioned image forming operation. Then, in the second transferring part 18, the toner image having full color on the intermediate transferring belt 6 is second-transferred onto the sheet. The sheet with the second-transferred toner image is conveyed to a downstream side on the conveying path 16 to enter the fixing part 20, and then, the toner image is fixed on the sheet in the fixing part 20. The sheet with the fixed toner image is ejected from the sheet ejection port 21 onto the ejected sheet tray 4.

Next, the fixing device 20 will be described in detail. Hereinafter, it will be described so that a front side of the fixing device 20 is positioned at the near side on FIG. 2, for convenience of explanation. Arrows Fr, Rr, L, R, U and Lo in each figure respectively indicate the front side, a rear side, a left side, a right side, an upper side and a lower side of the fixing device 20. An arrow Y in FIG. 2 indicates a conveying direction of the sheet. An arrow I in each figure indicates the inside in front and rear directions and an arrow O in each figure indicates the outside in front and rear directions.

Figure 2:
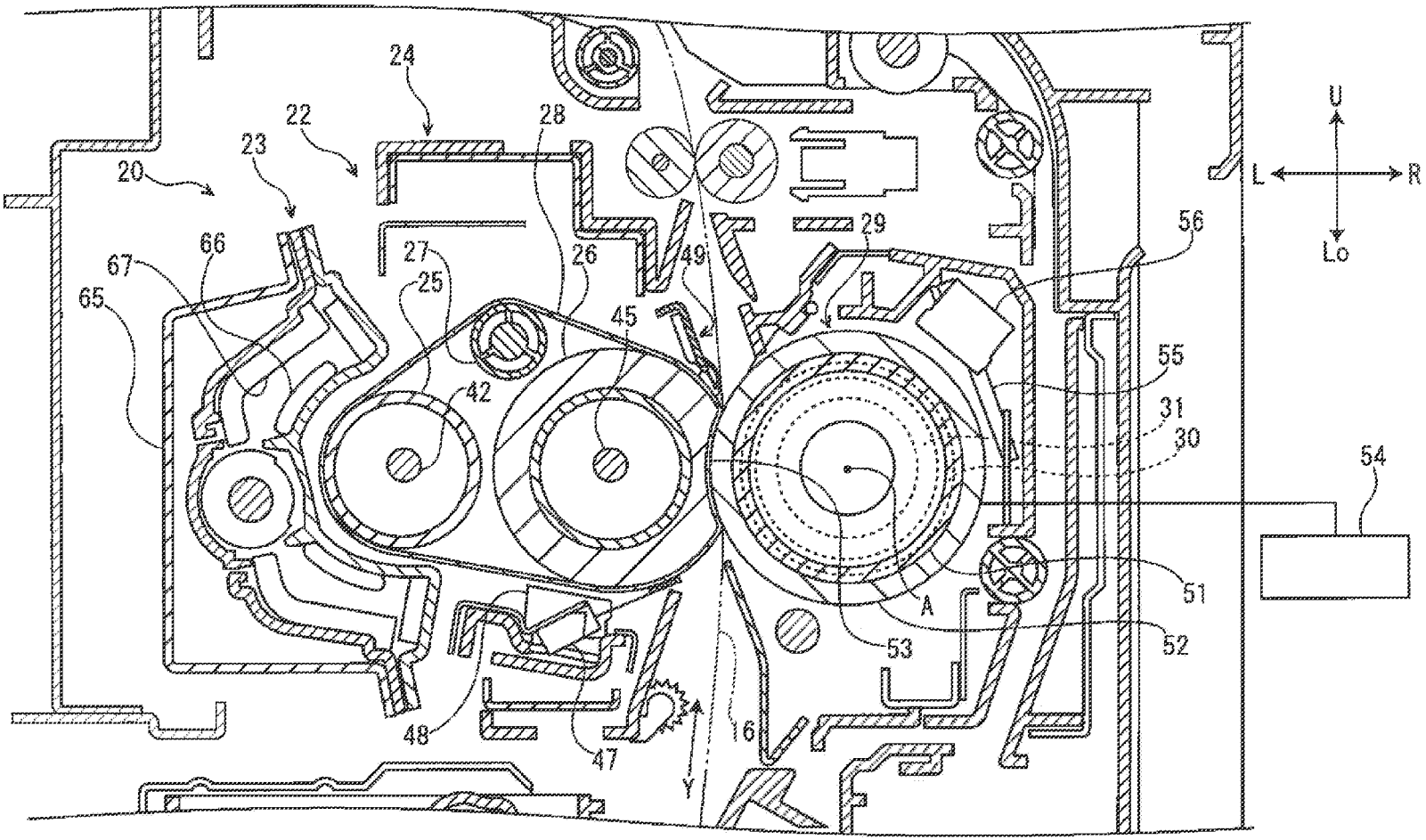
FIG. 2 is a sectional view showing a fixing device according to the first embodiment of the present disclosure.

As shown in FIG. 2, the fixing device 20 includes a fixing unit 22 and an induction heating (IH) unit 23 arranged at the left side of the fixing device 20.

First, the fixing unit 22 will be described. The fixing unit 22 includes a box-like formed fixing frame 24, a heating roller 25, a fixing roller 26, a tension roller 27, a fixing belt 28 (a heating member), a pressuring roller 29 (a rotating member), bearings 30 and heat insulating bushes 31 (heat insulating members). The heating roller 25 is arranged at a left end side of the fixing frame 24. The fixing roller 26 is arranged at the right side of the heating roller 25. The tension roller 27 is arranged at a right upper side of the heating roller 25 and at a left upper side of the fixing roller 26. The fixing belt 28 is wound around the heating roller 25, the fixing roller 26 and the tension roller 27. The pressuring roller 29 (a rotating member) is arranged at the right side of the fixing belt 28. Each bearing 30 and each heat insulating bush 31 are arranged at each of the front side and the rear side of the pressuring roller 29.

Figure 3:
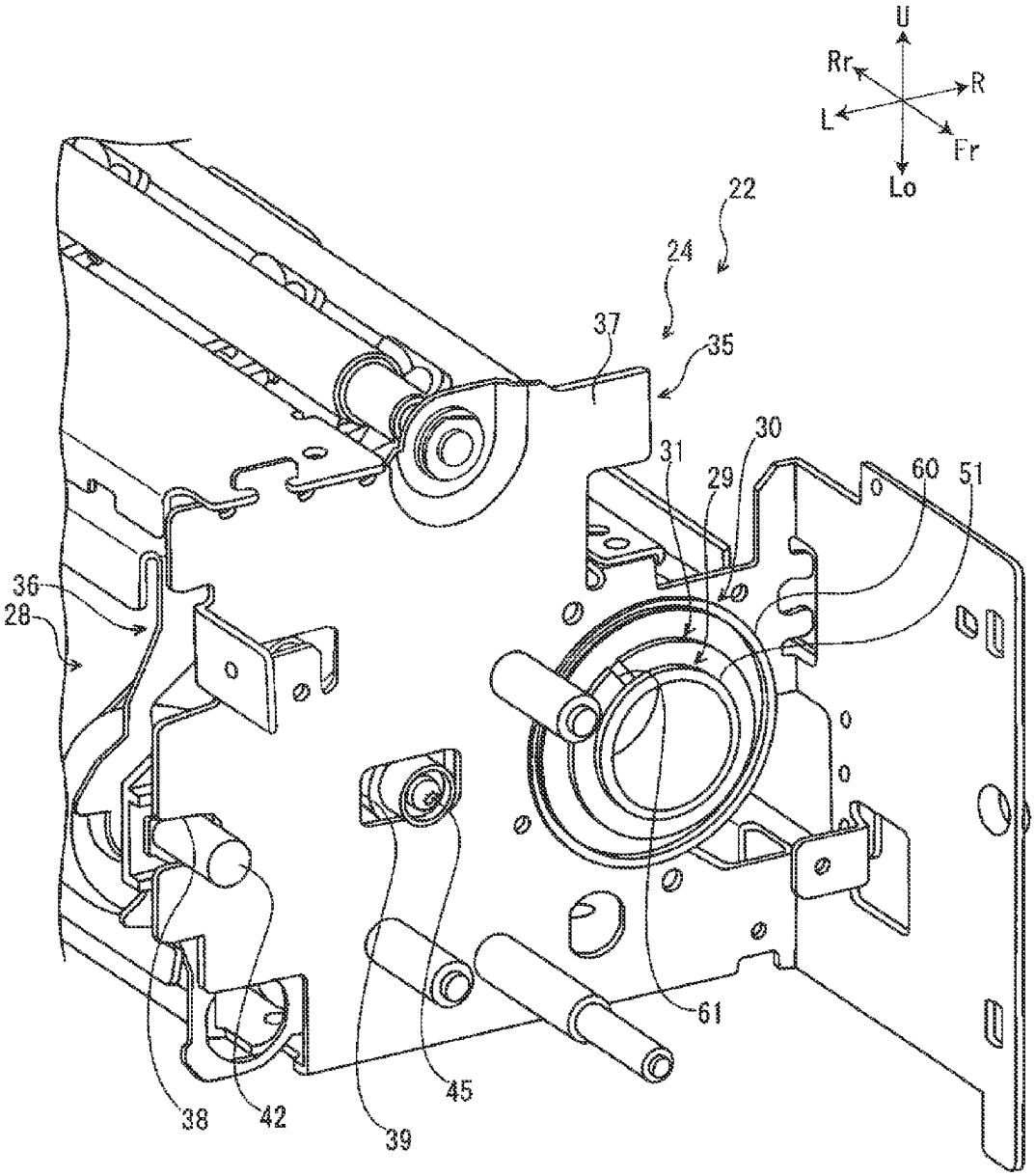
FIG. 3 is a perspective view showing a front end part of a fixing frame and its periphery in the fixing device according to the first embodiment of the present disclosure.
Figure 4:
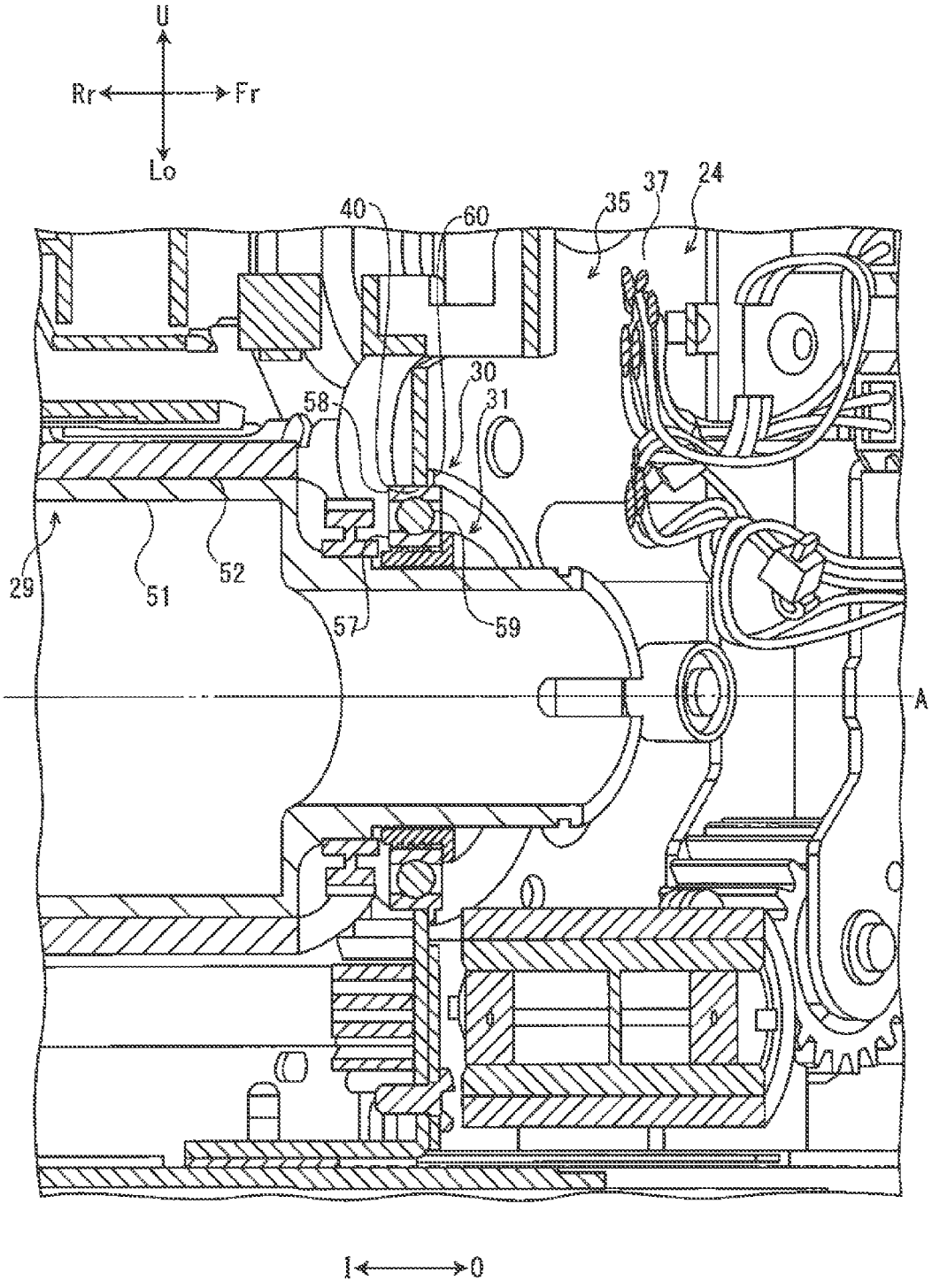
FIG. 4 is a sectional view showing a front end part of a pressuring roller and its periphery in the fixing device according to the first embodiment of the present disclosure.

As shown in FIG. 3, the fixing frame 24 includes an immovable frame part 35 and a movable frame part 36 supported slidably in the left and right directions by the immovable frame part 35. In left end parts of both front and rear wall parts 37 (FIG. 3 shows only the front wall part 37) of the immovable frame part 35, engaged gaps 38 are formed. In left side parts of both the front and rear wall parts 37 of the immovable frame part 35, engaged holes 39 are formed at the right side of the engaged gaps 38. As shown in FIG. 4 and others in right end parts of both the front and rear wall parts 37 of the immovable frame part 35, fitted holes 40 are formed.

The heating roller 25 (refer to FIG. 2 and others) includes a first rotation shaft 42. As shown in FIG. 3, both front and rear end parts of the first rotation shaft 42 are engaged with the engaged gaps 38 arranged in both the front and rear wall parts 37 of the immovable frame part 35 of the fixing frame 24 in a slidable state in the left and right directions.

The fixing roller 26 (refer to FIG. 2 and others) is faced to the pressuring roller 29 across the fixing belt 28. The fixing roller 26 includes a second rotation shaft 45. As shown in FIG. 3, both front and rear end parts of the second rotation shaft 45 are engaged with the engaged holes 39 arranged in both the front and rear wall parts 37 of the immovable frame part 35 of the fixing frame 24 in a slidable state in the left and right directions.

The tension roller 27 (refer to FIG. 2 and others) is biased to the right upper side by a coil spring (not shown) to press the fixing belt 28 to the right upper side. Thereby, constant tension is applied to the fixing belt 28.

The fixing belt 28 (refer to FIG. 2 and other figures) is made of a flexible belt. The fixing belt 28 is composed of, for example, a base material layer, an elastic layer provided around the base material layer and a release layer covering the elastic layer. The base material layer of the fixing belt 28 is made of, for example, metal, such as nickel or stainless steel, or resin, such as polyimide (PI). The elastic layer of the fixing belt 28 is made of, for example, silicone rubber. The release layer of the fixing belt 28 is made of, for example, fluorine based resin, such as perfluoro alkoxy alkane (PFA). FIG. 2 shows the respective layers (the base material layer, the elastic layer and the release layer) of the fixing belt 28 without distinguishing.

At the lower side of the fixing belt 28, a first thermistor 47 detecting temperature of the fixing belt 28 is located and a first thermostat 48 preventing excessive temperature rise of the fixing belt 28 is located. At the right upper side of the fixing belt 28, a separating member 49 separating the sheet from an outer circumference face of the fixing belt 28 is arranged. The fixing belt 28 is rotatably supported by the movable frame 36 (refer to FIG. 3) of the fixing frame 24 via the heating roller 25, the fixing roller 26 and the tension roller 27.

The pressuring roller 29 (refer to FIG. 2 and other figures) is composed of a cylindrical core member 51, an elastic layer 52 provided around the core material 51 and a release layer (not shown) covering the elastic layer 52. The core material 51 of the pressuring roller 29 is made of, for example, metal, such as iron, stainless steel or aluminum. The elastic layer 52 of the pressuring roller 29 is made of, for example, silicone rubber or silicone sponge. The release layer of the pressuring roller 29 is made of, for example, fluorine based resin, such as PFA.

The pressuring roller 29 comes into pressure contact with the fixing belt 28 and, between the fixing belt 28 and the pressuring roller 29, a fixing nip 53 is formed. The pressuring roller 29 is connected to a drive source 54 composed of a motor or the like so that the drive source 54 can rotate the pressuring roller 29. Incidentally, FIG. 2 schematically shows the drive source 54 and an illustrated position of the drive source 54 on FIG. 2 is not always matched with an actual position of the drive source 54.

At the right upper side of the pressuring roller 29, a second thermistor 55 detecting temperature of the pressuring roller 29 is located and a second thermostat 56 preventing excessive temperature rise of the pressuring roller 29 is located.

As shown in FIG. 4 and other figures, the bearings 30 respectively hold both front and rear end parts of the core member 51 of the pressuring roller 29 via the heat insulating bushes 31 (described later in detail). Thereby, the bearings 30 rotatably support the pressuring roller 29.

Each bearing 30 is composed of, for example, a ball bearing. Each bearing 30 includes an inner ring 57, an outer ring 58 located at an outer diameter side of the inner ring 57 and a plurality of balls (rollers) 59 sandwiched between the inner ring 57 and the outer ring 58. The outer ring 58 of each bearing 30 is fitted to the fitted hole 40 arranged in each of both the front and rear wall parts 37 of the immovable frame part 35. Thereby, the bearings 30 are held by both the front and rear wall parts 37 of the immovable frame part 35. On an outer circumference face of the outer ring 58 of each bearing 30, an annular protruding part 60 is arranged. An inside face in the front and rear directions of the protruding part 60 comes into contact with an outside face in the front and rear directions of each of both the front and rear wall parts 37 of the immovable frame part 35.

Figure 5:
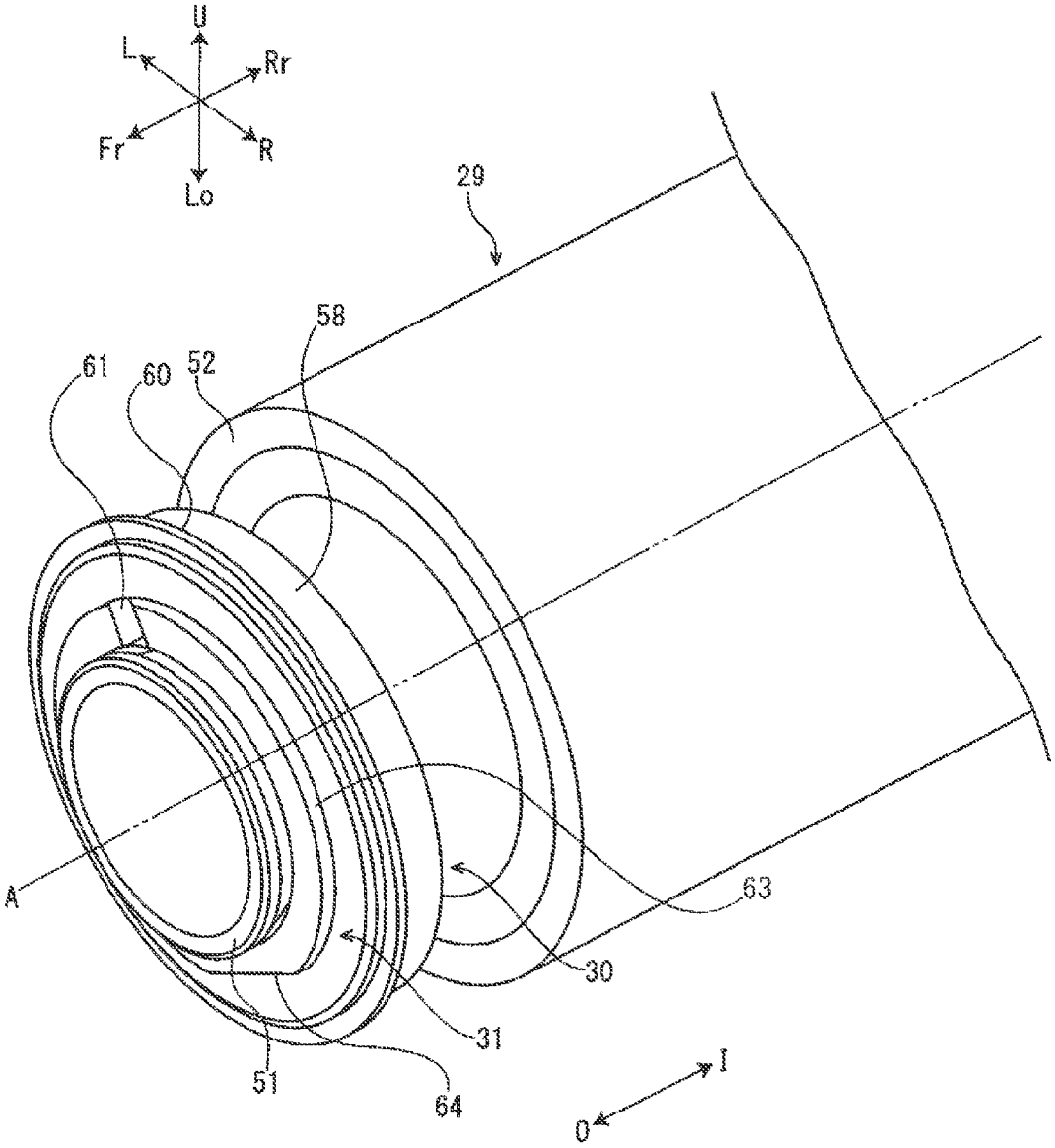
FIG. 5 is a perspective view showing the pressuring roller, a bearing and a heat insulating bush in the fixing device according to the first embodiment of the present disclosure.

As shown in FIG. 5 and other figures, each heat insulating bush 31 is sandwiched between each of both the front and rear end parts of the core member 51 of the pressuring roller 29 and each bearing 30. Each heat insulating bush 31 is configured so as to be rotatable around a rotation axis A extending in the front and rear directions on the same axis as the pressuring roller 29. That is, in the embodiment, the front and rear directions are correspondent with a direction of the rotation axis of the pressuring roller 29 and the heat insulating bushes 31.

Figure 6:
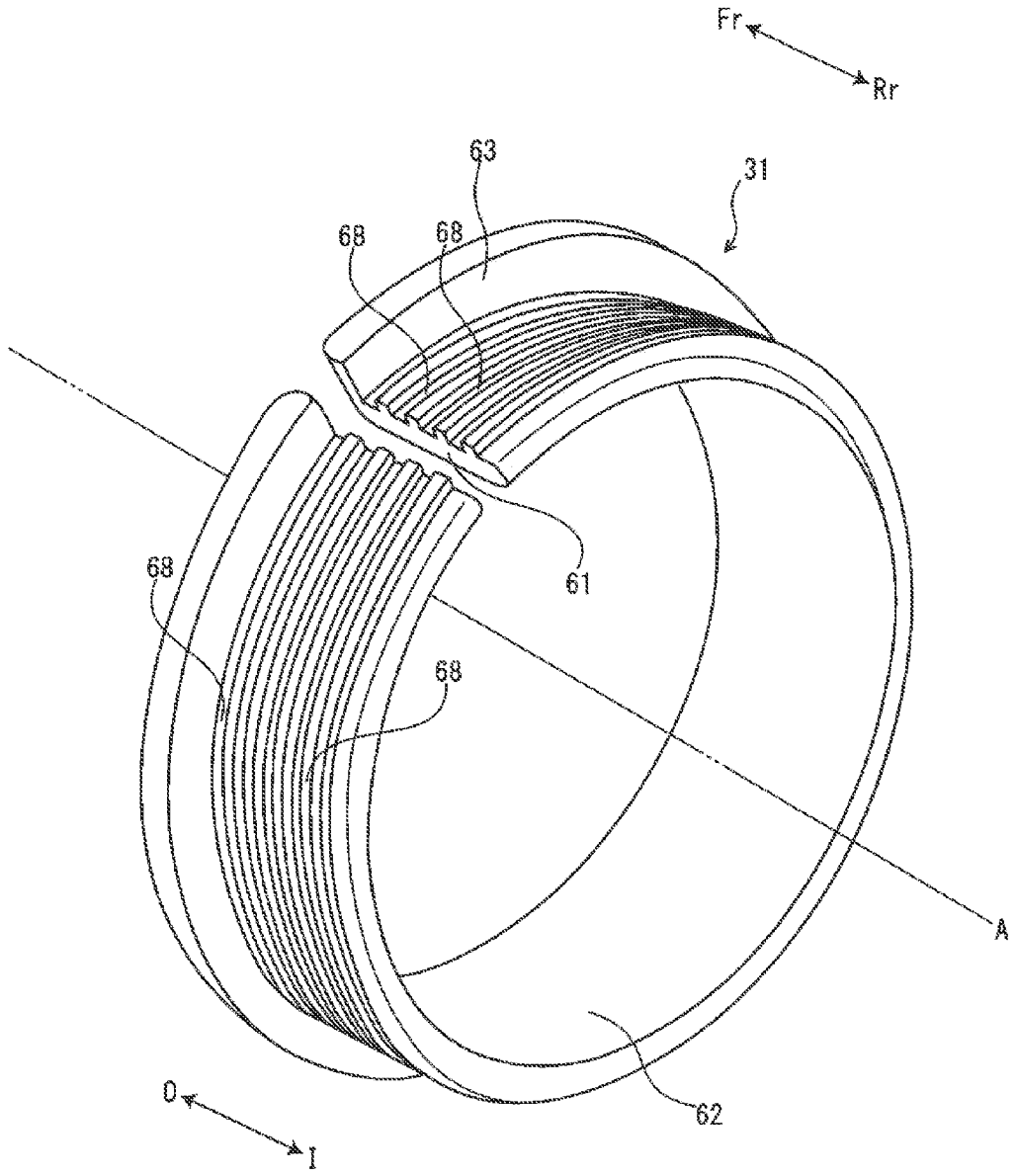
FIG. 6 is a perspective view showing the heat insulating bush in the fixing device according to the first embodiment of the present disclosure.

As shown in FIG. 6 and other figures, in a portion in a circumferential direction of each heat insulating bush 31, a notch part 61 (a discontinuous part) extending in the front and rear directions is provided. The notch part 61 is formed in a slitting shape so as to continue from an end part at the inside to an end part at the outside in the front and rear directions of each heat insulating bush 31. Therefore, each heat insulating bush 31 is formed in a C-shape as viewed from the front side (as viewed in the front and rear directions)

Figure 7:
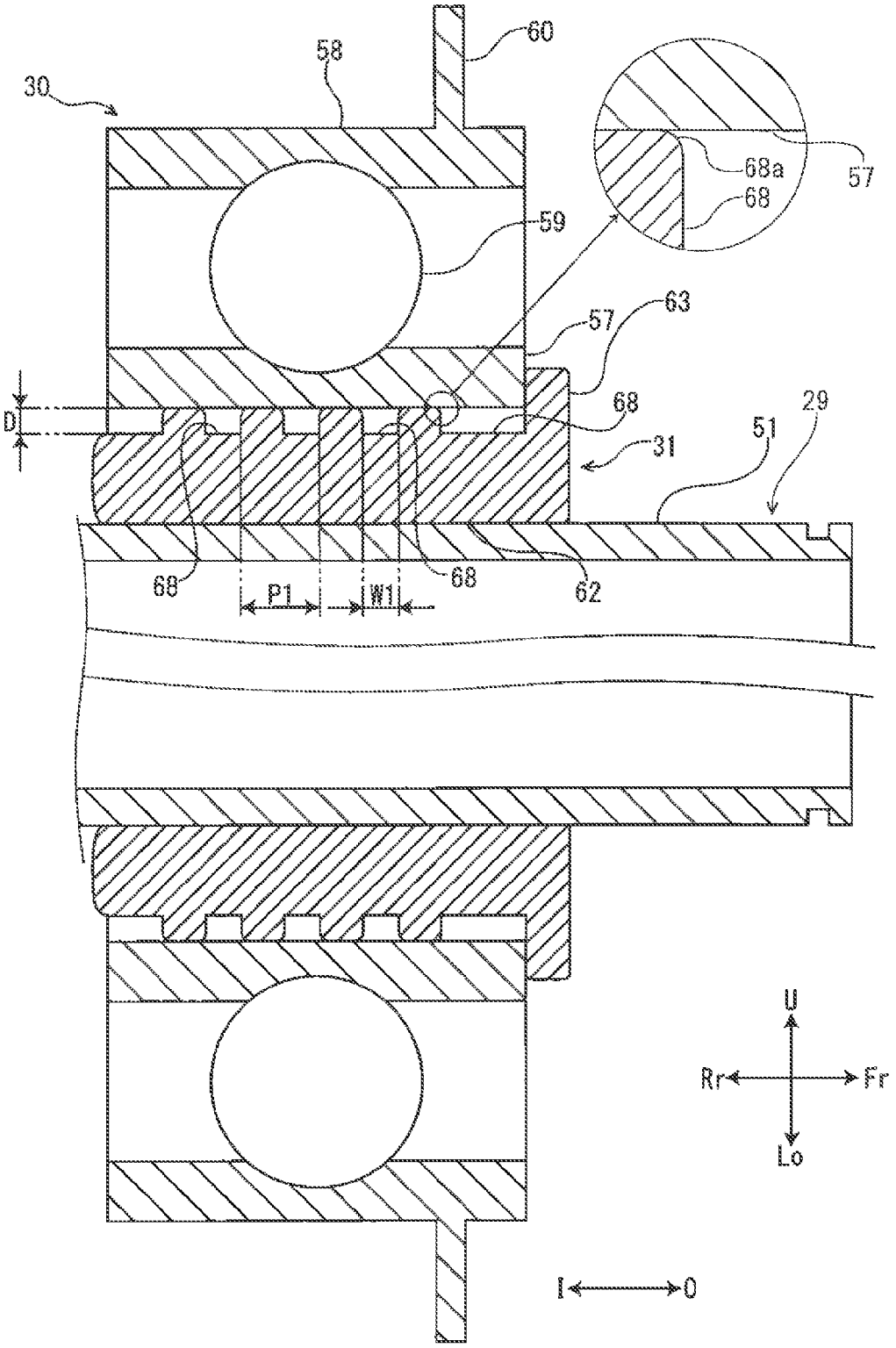
FIG. 7 is a sectional view showing the pressuring roller, the bearing and the heat insulating bush in the fixing device according to the first embodiment of the present disclosure.

As shown in FIGS. 6 and 7 and other figures, each heat insulating bush 31 includes a bush main body 62 and a flange part 63 projected from the end part at the outside in the front and rear directions to an outer diameter side in the bush main body 62.

An inner circumference face of the bush main body 62 comes into contact with an outer circumference face of each of both the front and rear end parts of the core member 51 of the pressuring roller 29. An outer circumference face of the bush main body 62 comes into contact with an inner circumference face of the inner ring 57 of each bearing 30. Between the outer circumference face of the bush main body 62 and the inner circumference face of the inner ring 57 of each bearing 30, for example, lubricant, such as grease, is applied.

In a contact portion with the inner circumference face of the inner ring 57 of each bearing 30 in the outer circumference face of the bush main body 62, groove parts 68 are formed along the circumferential direction of each heat insulating bush 31. Each groove part 68 is provided so as to continue from one end part (an end part formed at one end side of the notch part 61) to another end part (an end part formed at another end side of the notch part 61) in a circumferential direction of the bush main body 62. A plurality of (e.g. five) groove parts 68 are arranged at intervals in the front and rear directions. An opening edge part 68*a* (refer to an enlarged section of FIG. 7) of each groove part 68 is curved in an arc shape. In other words, the opening edge part 68*a* of each groove part 68 is formed in a round shape. A forming pitch P1 (refer to FIG. 7) of the groove parts 68 in the front and rear directions is, for example, 1 mm-5 mm. A width W1 (refer to FIG. 7) of each groove part 68 in the front and rear directions is, for example, 1 mm-4 mm. A depth D (refer to FIG. 7) of each groove part 68 is, for example, 0.2 mm-1 mm. In each groove part 68, the lubricant is preserved.

An inside face in the front and rear directions of the flange part 63 comes into contact with an outside face in the front and rear directions of the inner ring 57 of each bearing 30. Thereby, movement toward the outside in the front and rear directions of each bearing 30 is restricted. In the flange part 63, a recessed part 64 (refer to FIG. 5 and other figures) is formed at an opposite side to the notch part 61.

Next, the IH unit 23 will be described. As shown in FIG. 2, the IH unit 23 includes a case member 65, an IH coil 66 (a heat source) and an arch core 67. The IH coil 66 is installed in the case member 65 and arranged in an arc shape along an outer circumference of the fixing belt 28. The arch core 67 is installed in the case member 65 and arranged along an outer circumference of the IH coil 66.

In the fixing device 18 configured as mentioned above, in order to fix the toner image onto the sheet, the drive source 54 works to rotate the pressuring roller 29. When the pressuring roller 29 is thus rotated, the fixing belt 28 coming into pressure contact with the pressuring roller 29 is co-rotated with the pressuring roller 29. In addition, in order to fix the toner image onto the sheet, high frequency current is made to flow through the IH coil 66. According to this, the IH coil 66 generates a magnetic field, this magnetic field acts to generate eddy current in the fixing belt 28 and the fixing belt 28 is heated. That is, by the IH coil 66, the fixing belt 28 is inductively heated. In such a situation, when the sheet is passed through the fixing nip 53, the sheet and the toner image is heated and pressured and the toner image is fixed onto the sheet.

Incidentally, when the fixing belt 28 is inductively heated by the IH coil 66 as mentioned above, the pressuring roller 29 coming into pressure contact with the fixing belt 28 is heated and the pressuring roller 29 is thermally expanded. According to this, it may be feared that a large load is applied to each heat insulating bush 31 interposed between the core member 51 of the pressuring roller 29 and each bearing 30 and each heat insulating bush 31 is broken. However, in the embodiment, as described above, since each heat insulating bush 31 includes the notch part 61, it is possible to deform each heat insulating bush 31 to an outer diameter side in accordance with thermal expansion of the pressuring roller 29. Accordingly, it is possible to reduce a load applied to each heat insulating bush 31 and to prevent each heat insulating bush 31 from being broken.

When each heat insulating bush 31 includes the notch part 61, an attached state of each bearing 30 may make torsion easily occur around the notch part 61 in each heat insulating bush 31 (an occurrence factor 1 of abnormal noise). Moreover, when temperature of each heat insulating bush 31 exceeds crystallization temperature, each heat insulating bush 31 may be thermally deformed to increase a contact area of the outer circumference face of the bush main body 62 of each heat insulating bush 31 (hereinafter, called as an "outer circumference face of each heat insulating bush 31") with the inner circumference face of the inner ring 57 of each bearing 30 (hereinafter, called as an inner circumference face of each bearing 30) (an occurrence factor 2 of abnormal noise). Further, according to forming of the fixing nip 53, a large load may be applied to each heat insulating bush 31 (an occurrence factor 3 of abnormal noise). If the above-mentioned occurrence factors 1-3 of abnormal noise are met at a time, it may be feared that so-called stick slip occurs between each bearing 30 and each heat insulating bush 31, and accordingly, the abnormal noise occurs.

However, in the embodiment, each groove part 68 is arranged in the contact portion with the inner circumference face of each bearing 30 in the outer circumference face of each heat insulating bush 31. Therefore, it is possible to decrease the contact area of each heat insulating bush 31 with each bearing 30 and to enhance contact pressure of a contact portion of each heat insulating bush 31 with each bearing 30. According to this, it is possible to restrain torsion from occurring around the notch part 61 in each heat insulating bush 31 and to restrain occurrence of the abnormal noise due to the torsion of each heat insulating bush 31 by simple structure.

In addition, each groove part 68 is arranged along the circumferential direction of each heat insulating bush 31. By applying such a configuration, it is possible to restrain a leak of the lubricant from each groove part 68. According to this, it is possible to enhance slidability between each heat insulating bush 31 and each bearing 30 and to restrain catching of each heat insulating bush 31 and each bearing 30.

Moreover, the plurality of groove parts 68 are arranged in intervals in the front and rear directions. By applying such a configuration, it is possible to further decrease the contact area of the outer circumference face of each heat insulating bush 31 with the inner circumference face of each bearing 30 and to further enhance the contact pressure of the contact portion of the outer circumference face of each heat insulating bush 31 with the inner circumference face of each bearing 30.

Further, since the opening edge part 68*a* of each groove part 68 is curved in the arc shape, the lubricant preserved in each groove part 68 is easily supplied to the contact portion of the outer circumference face of each heat insulating bush 31 with the inner circumference face of each bearing 30. Therefore, it is possible to enhance slidability between each heat insulating bush 31 and each bearing 30 and to restrain catching of each heat insulating bush 31 and each bearing 30.

Furthermore, the fixing device 20 includes the IH coil 66 and the fixing belt 28 inductively heated by the IH coil 66 and uses the pressuring roller 29 coming into pressure contact with the fixing belt 28 to form the fixing nip 53 as the rotating member. By applying such a configuration, it is possible to surely restrain torsion of each heat insulating bush 31 interposed between the pressuring roller 29 and each bearing 30.

Moreover, since each heat insulating bush 31 is made of one component, it is possible to easily assemble the fixing device 20 as compared with a case where a heat insulating bush is made of a plurality of components.

Figure 8A:
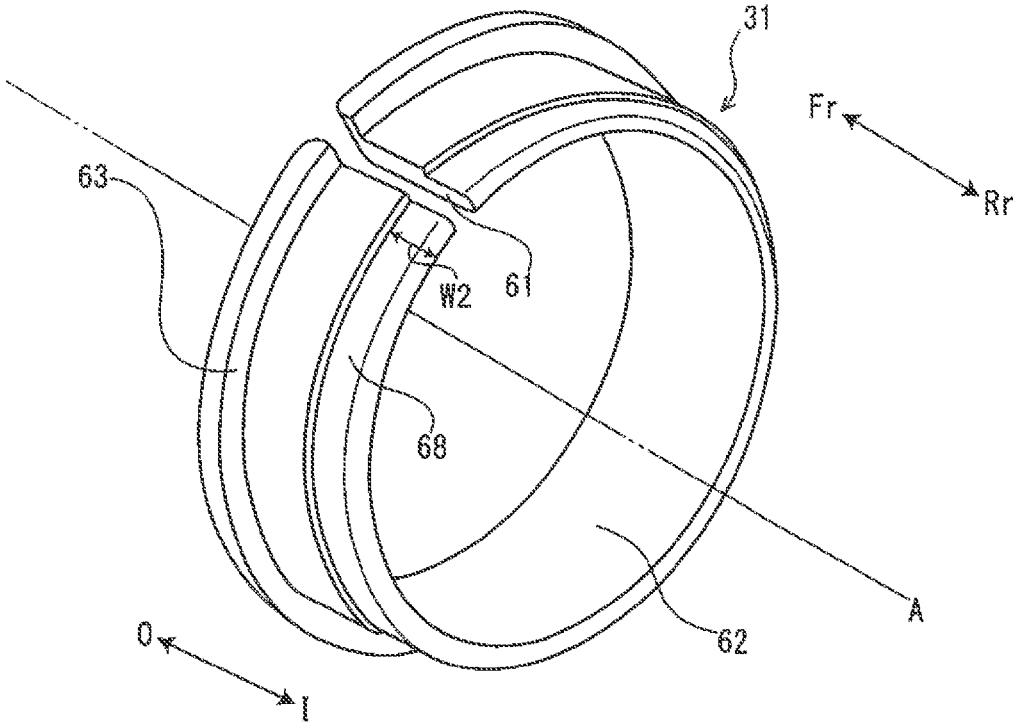
FIGS. 8A and 8B are perspective views showing the heat insulating bush in the fixing device according to other embodiments.

In the embodiment, a case of arranging the plurality of groove parts 68 at intervals in the front and rear directions was described. On the other hand, in another embodiment, as shown in FIG. 8A, only one groove part 68 may be arranged in a portion including an end part at the inside in the front and rear directions in the outer circumference face of each heat insulating bush 31. By applying such a configuration, it is possible to simplify structure of the one groove part 68. In a case of applying such a configuration, a width W2 of the one groove part 68 in the front and rear directions is, for example, 1 mm-4 mm.

Figure 8B:
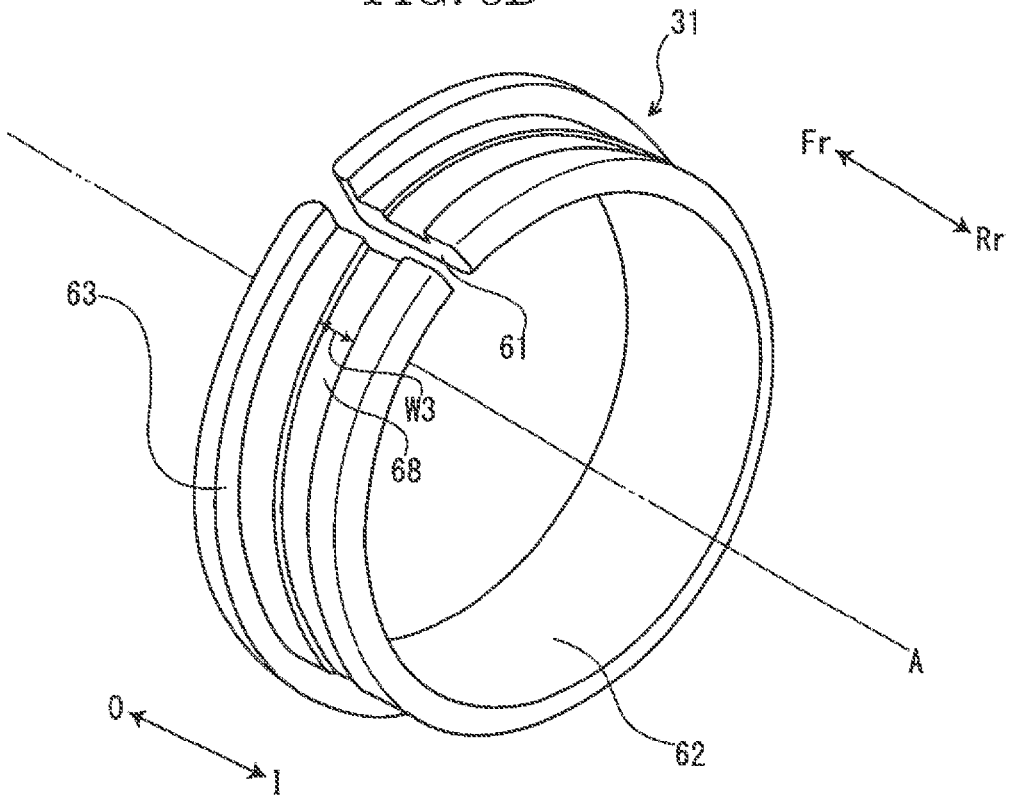

Moreover, in another embodiment, as shown in FIG. 8B, only one groove part 68 may be arranged in a middle part in the front and rear directions in the outer circumference face of each heat insulating bush 31, i.e. in a portion except both front and rear end parts in the outer circumference face of each heat insulating bush 31. In a case of applying such a configuration, a width W3 of the one groove part 68 in the front and rear directions is, for example, 0.5 mm-3 mm.

Although, in the embodiment, a case of using the fixing belt 28 as the heating member was described, in another embodiment, a fixing roller (a roller coming into pressure contact with the pressuring roller 29) may be used as the heating member.

Although, in the embodiment, a case of using the pressuring roller 29 as the rotating member was described, in another embodiment, the fixing belt 28 or a fixing roller (a roller coming into pressure contact with the pressuring roller 29) may be used as the rotating member.

In the embodiment, a case of applying a configuration of the present disclosure to the fixing device 20 in a manner winding the fixing belt 28 around a plurality rollers (the heating roller 25, the fixing roller 26 and the tension roller 27) arranged inside the fixing belt 28 was described. On the other hand, in another embodiment, the configuration of the disclosure may be applied to the fixing device 20 in a manner winding the fixing belt 28 around one roller arranged inside the fixing belt 28 or the fixing device 20 in a manner sliding the fixing belt 28 onto a pressuring member arranged inside the fixing belt 28.

Although, in the embodiment, a case of using the IH coil 66 as the heat source was described, in another embodiment, a heater, such as a halogen heater or a ceramic heater may be used as the heat source.

The embodiment was described in a case of applying the configuration of the present disclosure to the color printer 1. On the other hand, in another embodiment, the configuration of the disclosure may be applied to another image forming apparatus, such as a monochrome printer, a copying machine, a facsimile or a multifunction peripheral.

Second Embodiment

Next, a second embodiment of the present disclosure will be described. Incidentally, because configuration except each heat insulating bush 31 of the fixing device 20 is similar to the first embodiment, the description is omitted.

Figure 9:
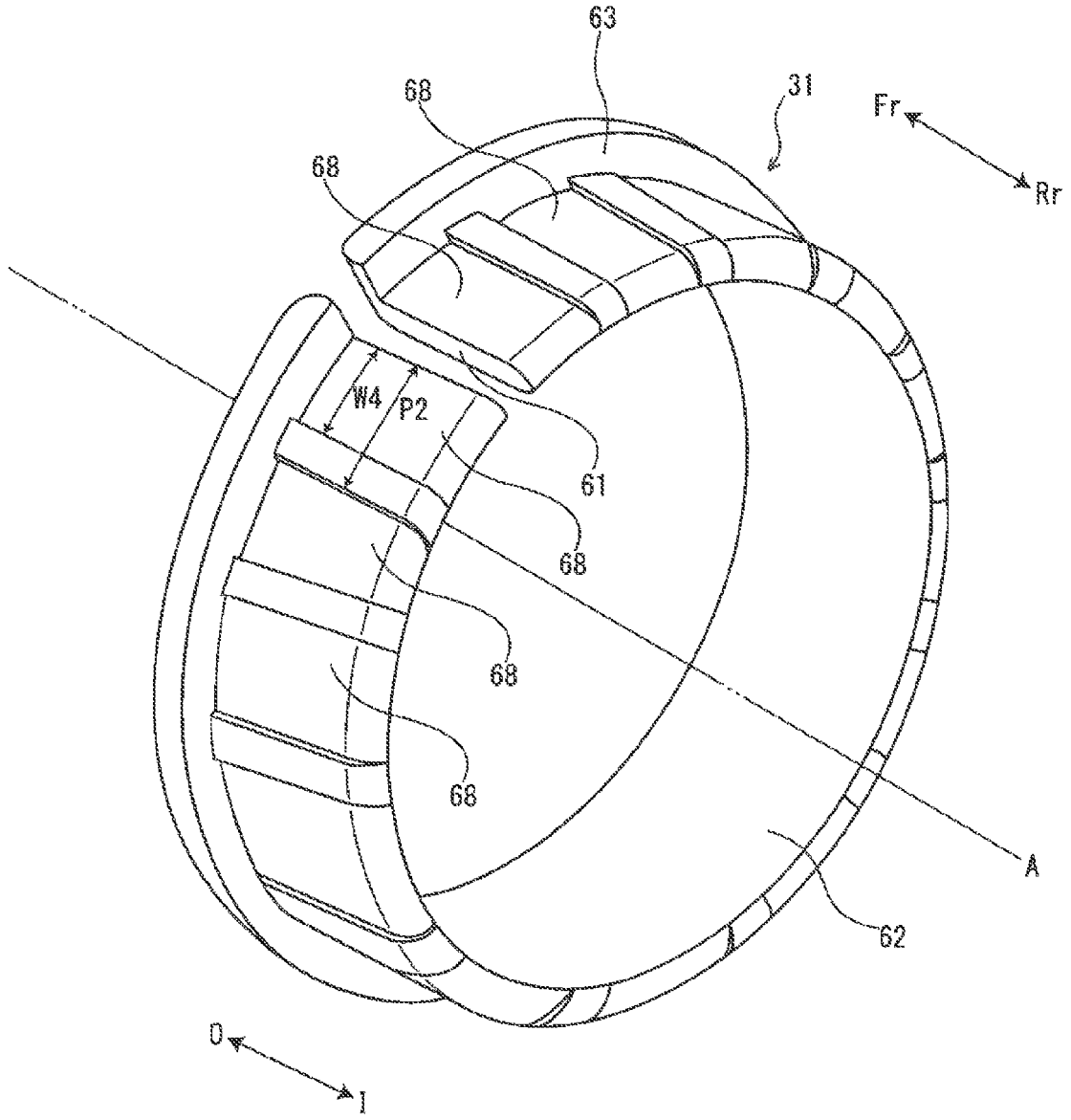
FIG. 9 is a perspective view showing the heat insulating bush in the fixing device according to a second embodiment of the present disclosure.

The first embodiment was described about a case of arranging each groove part 68 along the circumferential direction of each heat insulating bush 31. By contrast, in the embodiment, as shown in FIG. 9, each groove part 68 is arranged along the front and rear directions (the direction of the rotation axis of each heat insulating bush 31). By applying such a configuration, it is possible to easily form each groove part 68.

In addition, as shown in FIG. 9, in the embodiment, the plurality of groove parts 28 are arranged in a line at intervals in the circumferential direction of each heat insulating bush 31. By applying such a configuration, it is possible to further decrease the contact area of each heat insulating bush 31 with each bearing 30 and to further enhance the contact pressure of the contact portion of each heat insulating bush 31 with each bearing 30. In a case of applying such a configuration, a forming pitch P2 of the groove parts 68 in the circumferential direction is, for example, 1 mm-5 mm. A width W4 of each groove part 68 in the circumferential direction is, for example, 1 mm-4 mm.

Figure 10A:
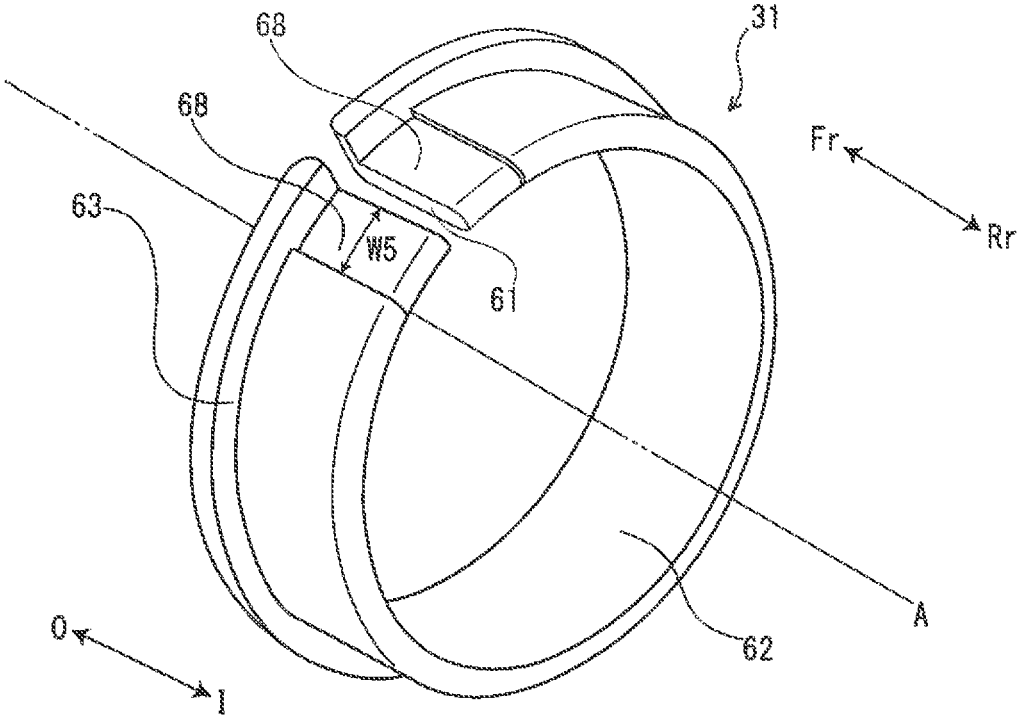
FIGS. 10A and 10B are perspective views showing the heat insulating bush in the fixing device according to other embodiments.

In the embodiment, a case of arranging the plurality of groove parts 28 in a line at intervals in the circumferential direction of each heat insulating bush 31 was described. On the other hand, in another embodiment, as shown in FIG. 10A, the groove parts 28 may be arranged one by one only in both end parts in the circumferential direction of the outer circumference face of each heat insulating bush 31. In a case of applying such a configuration, a width W5 of each groove part 68 in the circumferential direction is, for example, 1 mm-3 mm.

Figure 10B:
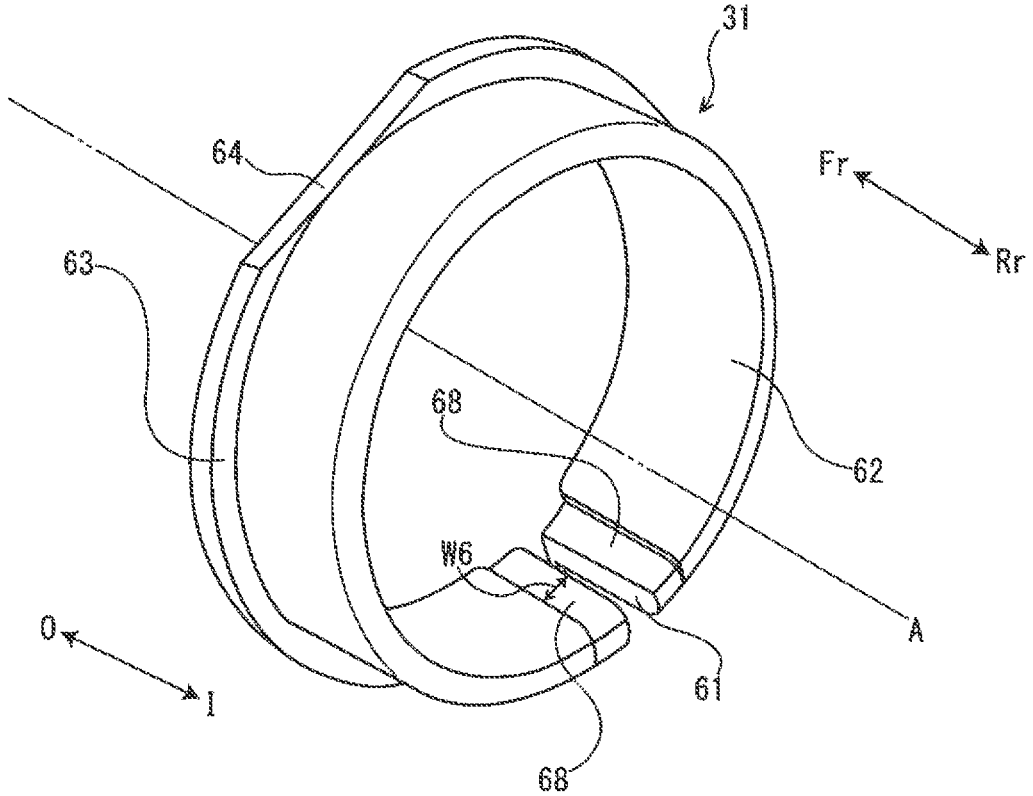

In the first embodiment and the second embodiment, a case of arranging each groove part 68 in the contact portion with the inner circumference face of each bearing 30 in the outer circumference face of each heat insulating bush 31 was described. On the other hand, in another embodiment, as shown in FIG. 10B, each groove part 68 may be arranged in a contact portion with the pressuring roller 29 in the inner circumference face of each heat insulating bush 31 (e.g. both end parts in the circumferential direction of the inner circumference face of each heat insulating bush 31). By applying such a configuration, it is possible to decrease a contact area of each heat insulating bush 31 with the pressuring roller 29 and to enhance contact pressure of a contact portion of each heat insulating bush 31 with the pressuring roller 29. In a case of applying such a configuration, a width W6 of each groove part 68 in the circumferential direction is, for example, 1 mm-3 mm.

Third Embodiment

Next, a third embodiment of the present disclosure will be described. Incidentally, because configuration except each heat insulating bush 31 of the fixing device 20 is similar to the first embodiment, the description is omitted. In addition, similar components of each heat insulating bush 31 to the first embodiment are indicated in the figures by the same reference numeral as the first embodiment and the description is omitted suitably.

Figure 11:
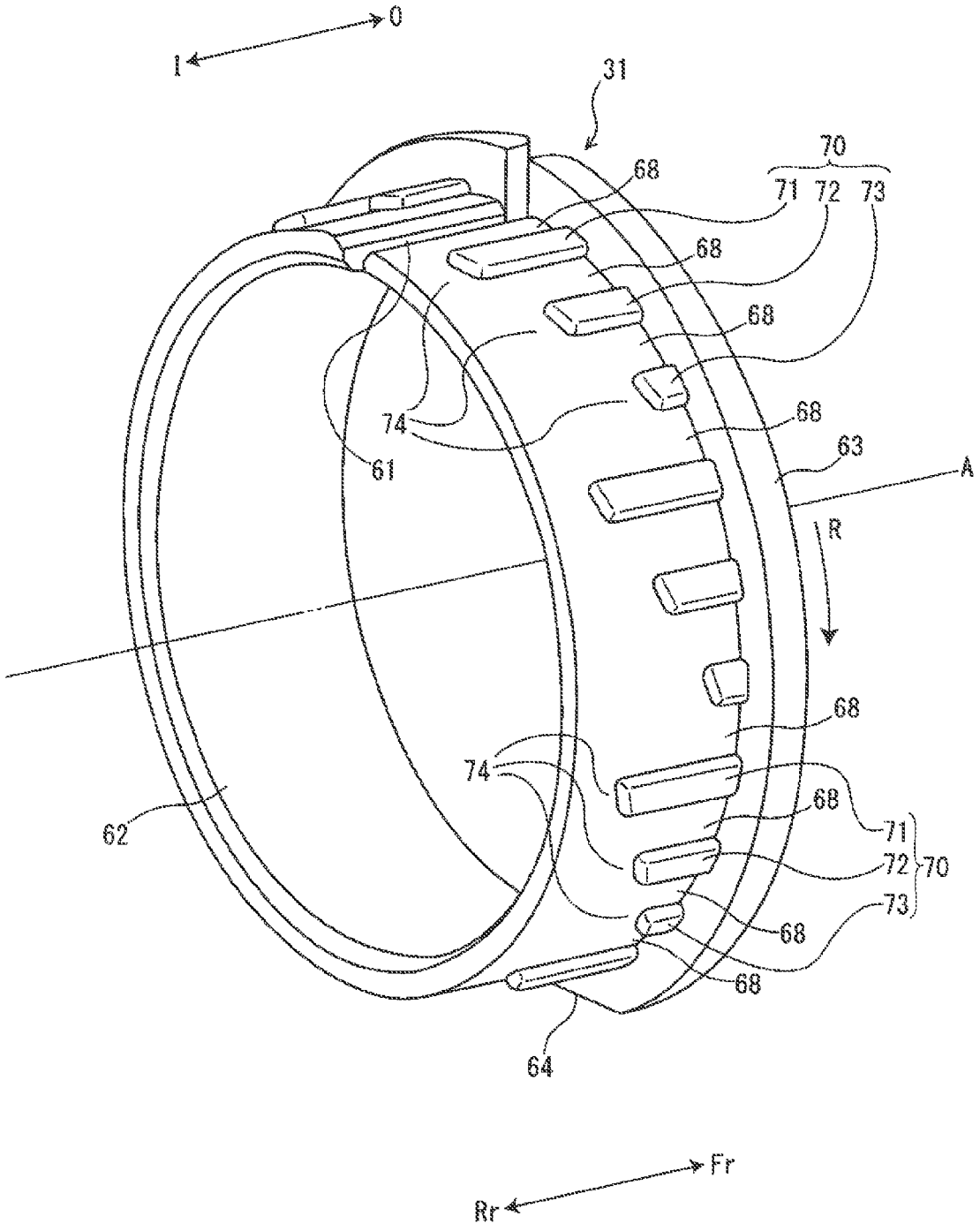
FIG. 11 is a perspective view showing the heat insulating bush in the fixing device according to a third embodiment of the present disclosure.
Figure 12:
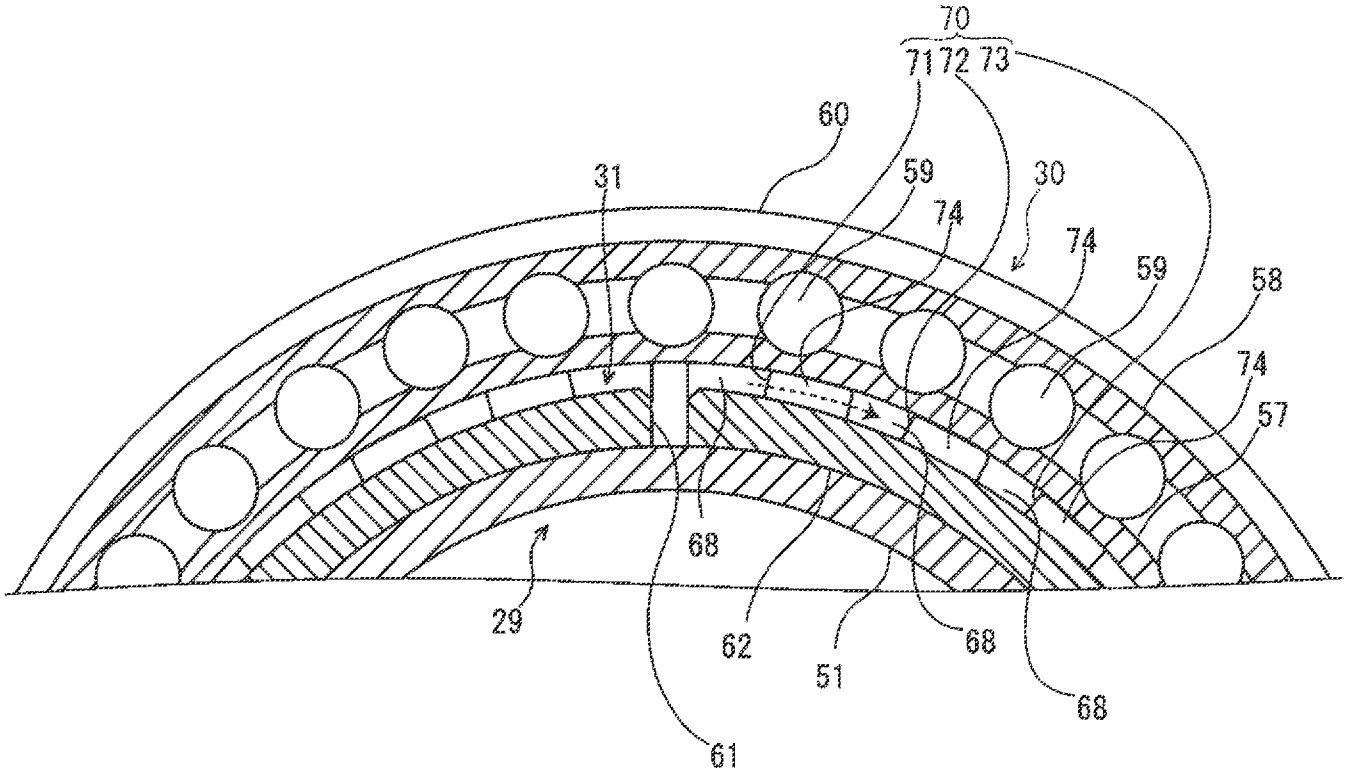
FIG. 12 is a sectional view showing the pressuring roller, the bearing and the heat insulating bush in the fixing device according to the third embodiment of the present disclosure.

As shown in FIGS. 11 and 12, in each heat insulating bush 31, in a contact portion with the inner circumference face of the inner ring 57 of each bearing 30 in the outer circumference face of the bush main body 62, the groove parts 68 are formed along the front and rear directions (the direction of the rotation axis of each heat insulating bush 31). The groove parts 68 are arranged in a line in the circumferential direction of each heat insulating bush 31.

Each heat insulating bush 31 includes first protruded parts 71, second protruded parts 72 and third protruded parts 73. Between adjacent groove parts 68, any one of first protruded parts 71, second protruded parts 72 and third protruded parts 73 is arranged. In the outer circumference face of the bush main body 62 of each heat insulating bush 31, communicating parts 74 are arranged at the inside from the first protruded parts 71, the second protruded parts 72 and the third protruded parts 73 in the front and rear directions. In a situation where each heat insulating bush 31 is assembled to each bearing 30, the adjacent groove parts 68 are communicated via each communicating part 74. Therefore, as indicated by a dotted arrow in FIG. 12, it is possible to flow the lubricant, such as grease, from one to another in the adjacent groove parts 68 via each communicating part 74. According to this, it is possible to evenly supply the lubricant over the entire area in the circumferential direction of each heat insulating bush 31 and to restrain from causing coating irregularity of the lubricant.

As shown in FIG. 11, in the outer circumference face of the bush main body 62 of each heat insulating bush 31, a plurality of protruded part groups 70 are arranged in the circumferential direction of each heat insulating bush 31 and each protruded part group 70 is composed of each first protruded part 71, each second protruded part 72 and each third protruded part 73 with different lengths in the front and rear directions. By applying such a configuration, it is possible to effectively restrain torsion from occurring around the notch part 61 in each heat insulating bush 31.

End parts at the outside in the front and rear directions of each first protruded part 71, each second protruded part 72 and each third protruded part 73 are connected to the inside face in the front and rear directions of the flange part 63. In each protruded part group 70, each first protruded part 71, each second protruded part 72 and each third protruded part 73 are arranged from an upstream side (one side in the circumferential direction of each heat insulating bush 31) to a downstream side (another side in the circumferential direction of each heat insulating bush 31) in a rotating direction R of each heat insulating bush 31 in order of each first protruded part 71, each second protruded part 72 and each third protruded part 73. Each first protruded part 71, each second protruded part 72 and each third protruded part 73 are made longer in the front and rear directions in order of each first protruded part 71, each second protruded part 72 and each third protruded part 73. That is, in the embodiment, lengths in the front and rear directions of each first protruded part 71, each second protruded part 72 and each third protruded part 73 of each protruded part group 70 are made gradually shorter from the upstream side to the downstream side in the rotating direction R of each heat insulating bush 31. Therefore, lengths in the front and rear directions of the communicating parts 74 of each protruded part group 70 are made gradually longer from the upstream side to the downstream side in the rotating direction R of each heat insulating bush 31. By applying such a configuration, it is possible to more effectively restrain torsion from occurring around the notch part 61 in each heat insulating bush 31.

Although, in the embodiment, a case where each protruded part group 70 is composed of each first protruded part 71, each second protruded part 72 and each third protruded part 73 was described, in another embodiment, each protruded part group 70 may be composed of two protruded parts or four or more protruded parts.

In the embodiment, a case where the lengths in the front and rear directions of each first protruded part 71, each second protruded part 72 and each third protruded part 73 of each protruded part group 70 are made gradually shorter from the upstream side to the downstream side in the rotating direction R of each heat insulating bush 31 was described. On the other hand, in another embodiment, the lengths in the front and rear directions of each first protruded part 71, each second protruded part 72 and each third protruded part 73 of each protruded part group 70 may be gradually shortened from the downstream side to the upstream side in the rotating direction R of each heat insulating bush 31. That is, the one side in the circumferential direction of each heat insulating bush 31 may be defined by either of the upstream side and the downstream side in the rotating direction R of each heat insulating bush 31.

Fourth Embodiment

Next, a fourth embodiment of the present disclosure will be described. Incidentally, because configuration except each heat insulating bush 31 of the fixing device 20 is similar to the first embodiment, the description is omitted. In addition, similar components of each heat insulating bush 31 to the first embodiment are indicated in the figures by the same reference numeral as the first embodiment and the description is omitted suitably.

Figure 13:
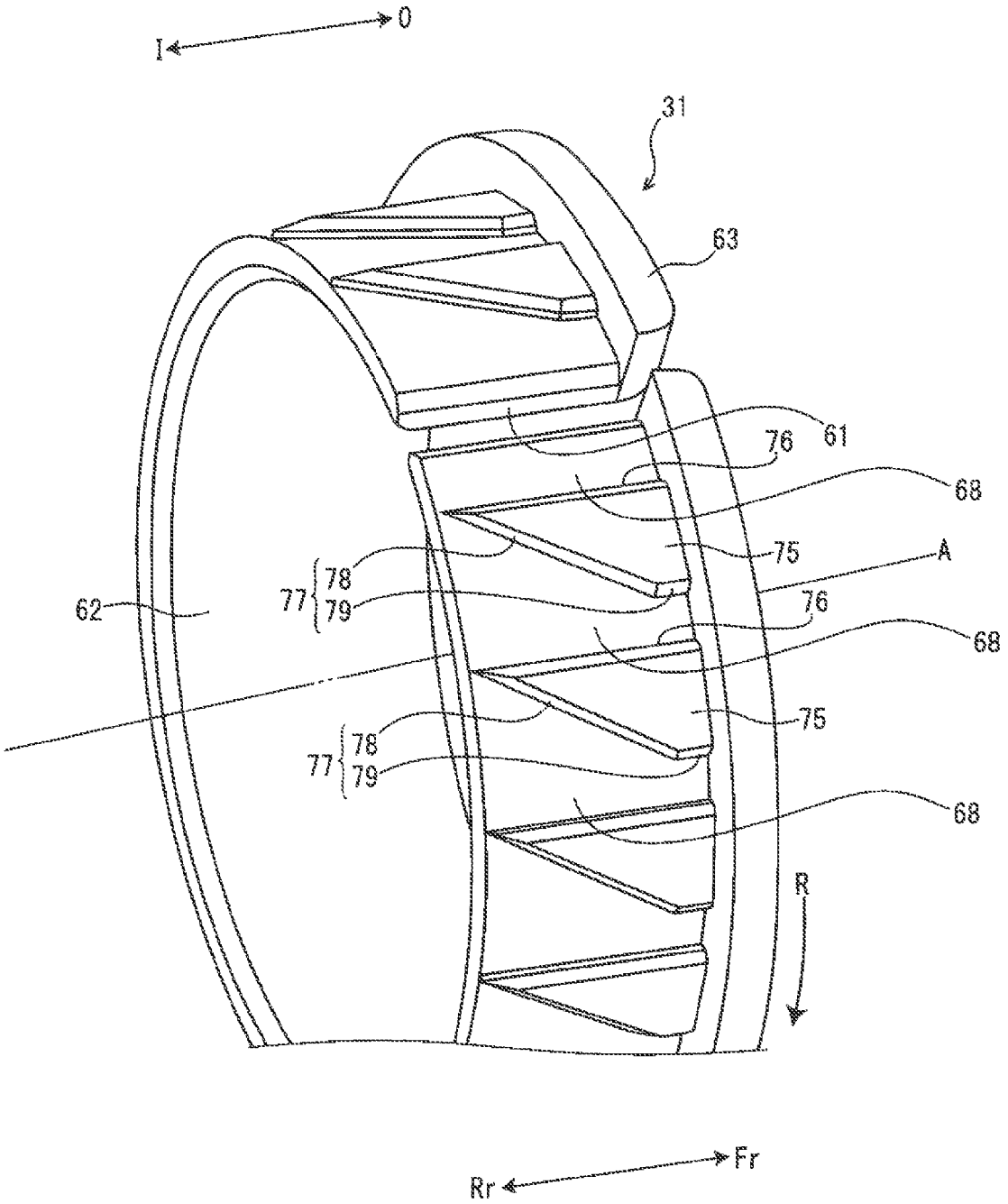
FIG. 13 is a perspective view showing the heat insulating bush in the fixing device according to a fourth embodiment of the present disclosure.

As shown in FIG. 13, in each heat insulating bush 31, in a contact portion with the inner circumference face of the inner ring 57 of each bearing 30 (not shown in FIG. 13) in the outer circumference face of the bush main body 62, the groove parts 68 are formed along the front and rear directions (the direction of the rotation axis of each heat insulating bush 31). The groove parts 68 are arranged in a line in the circumferential direction of each heat insulating bush 31.

Each heat insulating bush 31 includes protruded parts 75. Between adjacent groove parts 68, any one of protruded parts 75 is arranged. An end part at the outside in the front and rear directions of each protruded part 75 is connected to the inside face in the front and rear directions of the flange part 63. Each protruded part 75 is formed in a tapered shape toward the inside in the front and rear directions. A distal end part (an end part at the inside in the front and rear directions) of each protruded part 75 is formed in an acuminate shape to reach the end part at the inside in the front and rear directions of each heat insulating bush 31. By applying such a configuration, it is possible to effectively restrain torsion from occurring around the notch part 61 in each heat insulating bush 31.

A first side edge part 76 (in the embodiment, a side edge part at the upstream side in the rotating direction R of each heat insulating bush 31) of each protruded part 75 is arranged in parallel to the front and rear directions. A second side edge part 77 (in the embodiment, a side edge part at the downstream side in the rotating direction R of each heat insulating bush 31) of each protruded part 75 includes an inclined part 78 inclined to the front and rear directions and a non-inclined part 79 in parallel to the front and rear directions. The non-inclined part 79 is arranged so as to continue with the inclined part 78 at the outside of the inclined part 78 in the front and rear directions. A length of the non-inclined part 79 in the front and rear directions is longer than a length of the inclined part 78 in the front and rear directions. By applying such a configuration, it is possible to further effectively restrain torsion from occurring around the notch part 61 in each heat insulating bush 31.

In the embodiment, a case of using the side edge part at the upstream side in the rotating direction R of each heat insulating bush 31 as the first side edge part 76 and using the side edge part at the downstream side in the rotating direction R of each heat insulating bush 31 as the second side edge part 77 was described. On the other hand, in another embodiment, the side edge part at the downstream side in the rotating direction R of each heat insulating bush 31 may be used as the first side edge part 76 and the side edge part at the upstream side in the rotating direction R of each heat insulating bush 31 may be used as the second side edge part 77.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a rotating member fixing a toner image onto a recording medium;

a bearing rotatably supporting the rotating member; and a heat insulating member interposed between the rotating member and the bearing and rotated around a rotation axis;

wherein a notch part is arranged in a portion in a circumferential direction of the heat insulating member so as to continue from an end part at an inside to an end part at an outside in a direction of the rotation axis, at least one groove part is formed in a contact portion with the bearing in an outer circumference face of the heat insulating member.

2. The fixing device according to claim 1, wherein the groove part is formed along the circumferential direction of the heat insulating member.

3. The fixing device according to claim 2, wherein a plurality of groove parts are arranged at intervals in the direction of the rotation axis.

4. The fixing device according to claim 2, wherein only one groove part is arranged in a portion including an end part at the inside in the direction of the rotation axis in the circumference face of the heat insulating member.

5. The fixing device according to claim 2, wherein only one groove part is arranged in a portion except both end parts in the direction of the rotation axis in the circumference face of the heat insulating member.

6. The fixing device according to claim 1, wherein an opening edge part of the groove part is curved in an arc shape.

7. The fixing device according to claim 1, further comprising:

a heat source; and a heating member heated by the heat source, the rotating member is a pressuring roller coming into pressure contact with the heating member to form a fixing nip.

8. An image forming apparatus comprising:

the fixing device according to claim 1.

9. A fixing device comprising:

a rotating member fixing a toner image onto a recording medium;

a bearing rotatably supporting the rotating member; and a heat insulating member interposed between the rotating member and the bearing and rotated around a rotation axis;

wherein a notch part is arranged in a portion in a circumferential direction of the heat insulating member so as to continue from an end part at an inside to an end part at an outside in a direction of the rotation axis, at least one groove part is formed in a contact portion with the rotating member or the bearing in a circumference face of the heat insulating member, and wherein the groove part is formed along the direction of the rotation axis.

10. The fixing device according to claim 9, wherein a plurality of groove parts are arranged in a line in a circumferential direction of the heat insulating member.

11. The fixing device according to claim 10, wherein a protruded part is arranged between adjacent groove parts, a communicating part is arranged at an inside from the protruded part in the direction of the rotation axis of the circumference face of the heat insulating member, the adjacent groove parts are communicated via the communicating part.

12. The fixing device according to claim 10, wherein the heat insulating member includes protruded parts and each protruded part is arranged between adjacent groove parts, a plurality of protruded part groups are arranged in the circumferential direction of the heat insulating member in the circumference face of the heat insulating member and each protruded part group is composed of the protruded parts with different lengths in the direction of the rotation axis.

13. The fixing device according to claim 12, wherein the protruded parts of each protruded part group have the lengths in the direction of the rotation axis made gradually shorter from one side to another side in the circumferential direction of the heat insulating member.

14. The fixing device according to claim 10, wherein a protruded part is arranged between adjacent groove parts, the protruded part is formed in a tapered shape toward the inside in the direction of the rotation axis.

15. The fixing device according to claim 14, wherein a first side edge part of the protruded part is arranged in parallel to the direction of the rotation axis, a second side edge part of the protruded part includes an inclined part inclined to the direction of the rotation axis.

16. The fixing device according to claim 9, wherein groove parts are arranged only in both end parts in the circumferential direction of the circumference face of the heat insulating member.

17. An image forming apparatus comprising:

the fixing device according to claim 9.

* * * * *